US012760611B1

(12) United States Patent
Zhang et al.

(10) Patent No.: US 12,760,611 B1
(45) Date of Patent: Oct. 13, 2026

(54) TRIGGER, TOOL, AND SYSTEM

(71) Applicant: Baker Hughes Oilfield Operations LLC, Houston, TX (US)

(72) Inventors: Zhihui Zhang, Katy, TX (US); YingQing Xu, Tomball, TX (US); Emerson Nunez Moran, Cypress, TX (US); Jason Harper, Cypress, TX (US); Matthew D. Solfronk, Katy, TX (US); Todd Christopher Jackson, Houston, TX (US); James Doane, Friendswood, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 19/298,932

(22) Filed: Aug. 13, 2025

(51) Int. Cl.
*E21B 23/04* (2006.01)
*E21B 33/12* (2006.01)

(52) U.S. Cl.
CPC ..... *E21B 23/042* (2020.05); *E21B 33/12* (2013.01); *E21B 2200/08* (2020.05)

(58) Field of Classification Search
CPC ..... E21B 23/00; E21B 23/042; E21B 2200/08
See application file for complete search history.

(56) References Cited

U.S. PATENT DOCUMENTS 2,191,783 A * 2/1940 Wells ..... E21B 33/1204 166/135
6,245,841 B1 6/2001 Yeager et al.
7,389,821 B2 * 6/2008 Xu ..... E21B 23/06 166/383
7,552,777 B2 * 6/2009 Murray ..... E21B 23/0412 166/381
7,661,471 B2 * 2/2010 Murray ..... E21B 33/1277 166/195
7,726,406 B2 * 6/2010 Xu ..... E21B 23/00 166/381
8,322,426 B2 12/2012 Wright et al.
9,068,411 B2 * 6/2015 O'Connor ..... E21B 23/00
9,664,007 B2 5/2017 Lopez et al.
9,759,039 B1 * 9/2017 Hardesty ..... E21B 33/13
10,150,713 B2 * 12/2018 Doud ..... C06B 45/32
(Continued)

FOREIGN PATENT DOCUMENTS

EP 0396383 A2 11/1990
GB 2515624 A * 12/2014 ..... E21B 23/06
(Continued)

*Primary Examiner* — Jennifer H Gay
(74) *Attorney, Agent, or Firm* — Baker Hughes Company

(57) ABSTRACT

A trigger, including a shell, and a DoD material, and an e match in contact with the DoD material. A trigger including a first DoD material disposed as a load support, a second DoD material about the load support, and an e-match in contact with the DoD. A downhole tool, including a housing, first and second conduits, a plug member disposed between the first and second conduits and biased to a position that allows flow past the plug member, and a trigger disposed to hold the plug member in a position that denies flow past the plug member, the trigger comprising a DoD material. A downhole tool, including a housing, a piston, and a trigger on the piston within an inlet chamber of the housing, the trigger reducing a piston area of the piston to an area smaller than the full piston area defined by the piston.

8 Claims, 5 Drawing Sheets

(56) References Cited

U.S. PATENT DOCUMENTS 10,167,691 B2 1/2019 Zhang et al.
10,221,641 B2 * 3/2019 Zhang ..... E21B 29/02
10,221,642 B2 * 3/2019 Zhang ..... E21B 29/02
10,221,643 B2 3/2019 Zhang et al.
10,253,590 B2 4/2019 Xu et al.
10,294,750 B2 * 5/2019 Aitken ..... E21B 34/063
10,364,630 B2 * 7/2019 Xu ..... E21B 43/1185
10,364,631 B2 7/2019 Xu et al.
10,364,632 B2 7/2019 Xu et al.
10,494,886 B2 12/2019 Xu et al.
10,570,685 B2 * 2/2020 Date ..... E21B 34/14
10,711,553 B2 * 7/2020 Kochanek ..... E21B 29/02
10,724,321 B2 * 7/2020 Leonard ..... C22C 21/00
10,865,617 B2 12/2020 Deng et al.
10,907,429 B2 2/2021 Xu et al.
11,015,409 B2 5/2021 Xu et al.
11,149,521 B2 * 10/2021 Kennedy ..... E21B 29/02
11,255,169 B2 * 2/2022 Tajallipour ..... E21B 47/18
11,268,364 B2 * 3/2022 Sherman ..... E21B 43/26
11,299,966 B1 * 4/2022 Krueger ..... E21B 36/00
11,352,862 B2 * 6/2022 Zachariah ..... E21B 29/02
11,674,074 B2 * 6/2023 Sherman ..... C09K 8/665
166/308.2
11,787,991 B1 10/2023 Zhao et al.
11,851,967 B2 * 12/2023 Zhang ..... E21B 41/00
11,988,067 B1 * 5/2024 Decuir ..... E21B 34/063
12,055,000 B2 8/2024 Xu et al.
12,084,617 B2 * 9/2024 Sherman ..... E21B 43/26
12,467,338 B1 * 11/2025 Deng ..... E21B 41/00
12,480,386 B2 * 11/2025 Krueger ..... E21B 43/10
2007/0125532 A1 * 6/2007 Murray ..... E21B 33/1216
166/179
2008/0066923 A1 * 3/2008 Xu ..... E21B 23/00
166/376
2008/0110615 A1 * 5/2008 Xu ..... E21B 23/06
166/373
2009/0314497 A1 12/2009 Johnson
2010/0206633 A1 8/2010 Moore et al.
2013/0312982 A1 * 11/2013 O'Connor ..... E21B 23/00
166/381
2014/0318780 A1 * 10/2014 Howard ..... E21B 34/06
166/317
2014/0345851 A1 11/2014 Wright et al.
2015/0239795 A1 * 8/2015 Doud ..... E21B 29/02
149/7
2016/0265310 A1 * 9/2016 Getzlaf ..... E21B 34/103
2016/0333655 A1 * 11/2016 Fripp ..... E21B 29/02
2016/0369592 A1 * 12/2016 Aitken ..... E21B 34/063
2017/0247996 A1 * 8/2017 Hardesty ..... E21B 34/063
2018/0073315 A1 * 3/2018 Date ..... E21B 21/103
2018/0171736 A1 * 6/2018 Xu ..... E21B 34/063
2018/0283141 A1 * 10/2018 Zhang ..... E21B 29/02
2018/0283142 A1 * 10/2018 Zhang ..... E21B 29/02
2018/0291698 A1 * 10/2018 Xu ..... E21B 33/1208
2018/0334607 A1 * 11/2018 Paxson ..... E21B 33/12
2019/0032435 A1 * 1/2019 Kochanek ..... E21B 33/12
2019/0106959 A1 * 4/2019 Leonard ..... C22C 5/04
2019/0186248 A1 * 6/2019 Sherman ..... C09K 8/665
2020/0102807 A1 * 4/2020 Kennedy ..... E21B 34/103
2021/0115767 A1 * 4/2021 Tajallipour ..... E21B 47/18
2021/0156234 A1 * 5/2021 Zachariah ..... E21B 43/12
2021/0189854 A1 * 6/2021 Sherman ..... C09K 8/70
2021/0254611 A1 8/2021 Hurst et al.
2021/0301633 A1 9/2021 Alnoaimi et al.
2021/0372254 A1 12/2021 Thomas et al.
2022/0025750 A1 * 1/2022 Sherman ..... C09K 8/70
2023/0258055 A1 * 8/2023 Zhang ..... E21B 41/00
166/317
2023/0304370 A1 * 9/2023 Zhang ..... C08G 59/245
2024/0301769 A1 9/2024 Xu et al.
2024/0392659 A1 * 11/2024 Krueger ..... E21B 43/10
2024/0410272 A1 * 12/2024 Zhang ..... E21B 47/138
2025/0012156 A1 1/2025 Ewing et al.

FOREIGN PATENT DOCUMENTS

WO WO-2020131051 A1 * 6/2020 ..... F15B 3/00
WO WO-2026015447 A1 * 1/2026 ..... E21B 41/0085

* cited by examiner

TRIGGER, TOOL, AND SYSTEM

BACKGROUND

In the resource recovery industry and fluid sequestration industry actuations of tools in the borehole environment are ubiquitous. Often such tools are actuated using hydraulic or explosive means that require more robust housings, etc. and hence limit tool design with regard to space and structural configuration, at least. While actuation using hydraulics and explosives is generally accepted in the art, alternatives that increase design opportunities and or eliminate the needs for regulated explosives would be welcomed by the art.

SUMMARY

An embodiment of a trigger, including a shell, and a DoD material disposed adjacent the shell piece, and an e match disposed in operable contact with the DoD material.

An embodiment of a trigger including a first DoD material disposed as a load support, a second DoD material wrapped about the load support; the two materials having gradient compositions, and an e-match disposed in operable contact with the first DoD material, the second DoD material, or both.

An embodiment of a downhole tool, including a housing, first and second conduits defined in the housing, a plug member disposed between the first and second conduits, the plug member be biased to a position that allows flow past the plug member, and a trigger disposed to hold the plug member in a position that denies flow past the plug member, the trigger comprising a DoD material.

An embodiment of a downhole tool, including a housing defining an inlet and an outlet for fluid, a piston disposed in the housing, and a trigger disposed on the piston within an inlet chamber of the housing, the trigger reducing a piston area of the piston from a full piston area defined by the piston to an area smaller than the full piston area defined by the piston.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
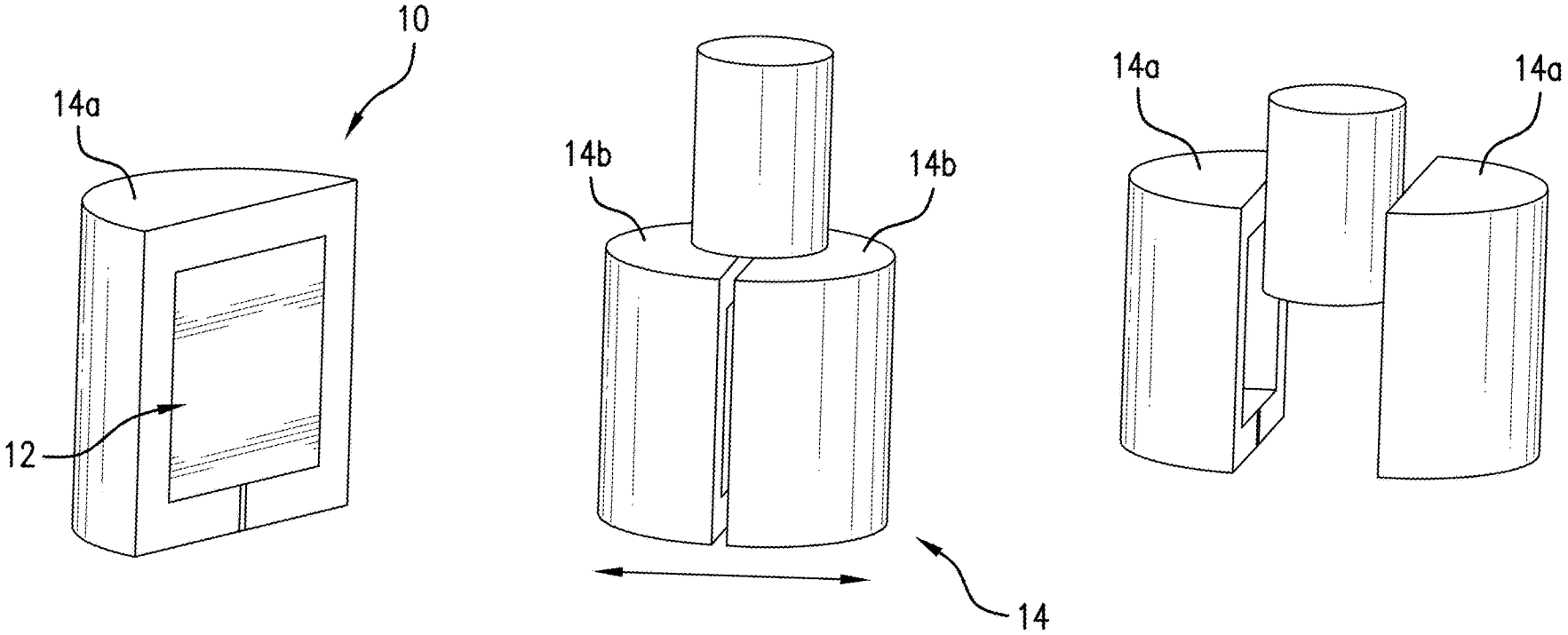
FIG. 1 illustrates schematically a sequence of positions for a first embodiment of a trigger outside of a tool in which the trigger might be used.

A detailed description of one or more embodiments of the disclosed apparatus and method are presented herein by way of exemplification and not limitation with reference to the Figures.

As disclosed herein, structural members may comprise Disappear on Demand (DoD) materials that upon ignition will rapidly (on the order of seconds) degrade and lose structural integrity or may be disposed in close proximity to DoD materials that when initiated create sufficient heat energy to affect the structural integrity of the structural member. That loss of integrity allows other forces (such as hydrostatic pressure, springs, etc.) acting on the tool to have effect.

Enabling each of the embodiments discussed herein is a DoD material that comprises an energetic material composition that generates heat without a significant generation of gas. Specifically, pressure production is generally less than 100 pounds per square inch (PSI) and in embodiments is less than about 50 PSI. This means that a structure of a particular tool need not be designed to manage higher pressures such as those created with explosive materials. The heat generated either alone or assisted by the small pressure evolution, will result in the degradation of the trigger component of the tool at issue, and thereby trigger the actuation of that tool.

The DoD material, once initiated, will undergo a self-sustained and self-propagated reaction that is not affected by downhole fluid or hydrostatic pressure. The self-sustained and self-propagated reaction generates heat and chemically decomposes a polymer in the polymer matrix. The decomposed product generated from the polymer decomposition includes small molecules that transform into a supercritical state when the temperature and pressure applied to the small molecules exceed the supercritical temperature and the supercritical pressure of the small molecules. Advantageously, the transformation of the small molecules to the supercritical state does not lead to dramatic pressure change, but nonetheless can facilitate the disintegration of the downhole articles in a safe and controllable manner.

The DoD material composition comprises a polymer and an energetic material. The polymer may be in the form of flakes or powder, or the polymer may form a coating on particles of the energetic material, or the polymer may form a matrix in which the energetic material is dispersed.

The polymer may include at least one of an epoxy resin, a phenolic resin, an epoxy phenolic resin, a vinyl ester, a cyanate ester, a polyester such as polyethylene terephthalate, a polyetheretherketone, a polyolefin such as ethylene or propylene based polymers including polyethylene or polypropylene homopolymers and copolymers of ethylene or propylene with other olefinic monomers, a styrene based polymer including polystyrene homopolymers or copolymers of styrene and other ethylenically unsaturated mononomers, polyamides, and polyimides such as polybismaleimide. The polymer may be free of the following explosophoric groups including nitro (nitrite) (—NO2), nitrito (—ONO), nitrate (—$NO_3$), azide (—N3), azo (—N═N—), azoxy [—N═N(O)], nitramine (—NHNO2), dinitromethane [—CH(NO2)2] and trinitromethane [—C(NO2)3 functional group such that the polymer does not release nitrogen gas when initiated. The nitrogen content in the polymer is less than 15 weight percent based on the total weight of the polymer. The polymer may have an oxygen content of about 2 to about 30 wt %. In some embodiments the oxygen content is about 3 to about 25 wt %. In other embodiments, the oxygen content is about 5 to about 20 wt %, based on a total weight of the polymer.

As used herein, "an epoxy" refers to a cured product of an epoxide that contains one or more epoxide groups. One epoxy suitable for use in the disintegrable articles can be formed from at least one of an aliphatic epoxide such as butanediol diglycidyl ether, a bisphenol epoxide such as bisphenol-A diglycidyl ether (CAS #1675-54-3) and/or bisphenol-F diglycidyl ether, or a novolac epoxide such as phenol-formaldehyde polymer glycidyl ether (CAS #28064-14-4). The curing agent includes an active group that can react with an epoxy group. Examples of such an active group include amino groups and acid anhydride groups. In an aspect the curing agent is at least one of an aliphatic amine or an aromatic amine.

The epoxy may exhibit an aromatic structure and an aliphatic structure in the backbone of the polymers, where the aliphatic structure contains an ether (C—O) bond. The aromatic structure may be difficult to decompose while the aliphatic structure may be easier to decompose. In an aspect, the epoxy contains a polymerized diglycidylether of a bisphenol wherein the number of the repeating units range from 0 to 18, preferably 0 to less than 2.5. For example, the epoxy can include a bisphenol A diglycidyl ether epoxy having the formula,

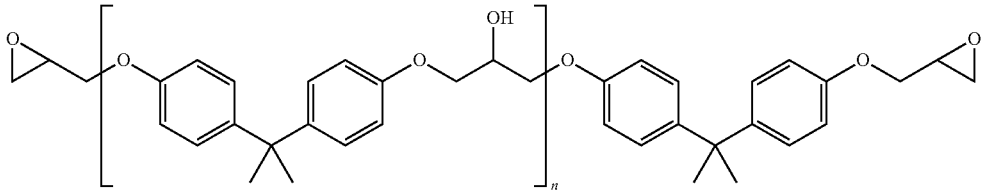

wherein n is the number of repeating units, and can be 0 to 18, preferably 0 to less than 2.5. Without wishing to be bound by theory, it is believed that when the repeating units are within these ranges, the epoxy can readily decompose when exposed to the heat generated by the self-propagation reaction of the energetic material described herein.

Phenolic resin, also known as phenolic formaldehyde resin, is a synthetic resin produced from the polymerization of a phenol ($C_6H_5OH$), an alkyl-substituted phenol, a halogen-substituted phenol, or a combination thereof, and a formaldehyde compound such as formaldehyde ($CH_2C{=}O$). The polymer can include repeating units such as —[($C_6H_3OH$)—$CH_2$]—.

Epoxy phenolic resin is phenolic resin modified at the phenolic hydroxyl group to include an epoxide functional group such as —$CH_2$—($C_2H_3O$), where —($C_2H_3O$) is a three-membered epoxide ring. The added functionality of the phenolic resin increases the ability for the resin to crosslink, creating a stronger polymer with high resistivities.

Vinyl ester (vinyl acetate) is a resin produced by the esterification of an epoxy resin with acrylic or methacrylic acids.

The polybismaleimide can be synthesized by condensation of phthalic anhydride with an aromatic diamine, which yields bismaleimide such as 4,4'-bismaleimidodiphenylmethane, followed by subsequent Michael addition of more diamine to the double bond at the ends of the bismaleimide. The monomer bismaleimide can also be copolymerized with vinyl and allyl compounds, allyl phenols, isocyanates, aromatic amines, or a combination thereof. Bismaleimide is often copolymerized with 2,2'-diallyl bisphenol A.

Cyanate esters are compounds generally based on a phenol or a novolac derivative, in which the hydrogen atom of the phenolic OH group is substituted by a cyanide group (—OCN). Suitable cyanate esters include those described in U.S. Pat. No. 6,245,841 and EP 0396383. Cyanate esters can be cured and postcured by heating, either alone, or in the presence of a catalyst. Curing normally occurs via cyclotrimerization (an addition process) of three CN groups to form three-dimensional networks comprising triazine rings.

The polyester can be formed by the reaction of a dibasic organic acid and a dihydric alcohol. Orthophthalic polyesters are made by phthalic anhydride with either maleic anhydride or fumaric acid. Isophthalic polyesters are made from isophthalic acid or terephthalic acid. Isophthalic polyesters are preferred due to the improved corrosion resistance and mechanical properties.

Returning to the second major component of the DoD material, the energetic material may include, for example, a reducing agent such as a metal powder and an oxidizing agent such as a metal oxide or a polymer that produces an exothermic oxidation-reduction reaction known as a thermite reaction. Choices for a reducing agent include at least one of aluminum, magnesium, calcium, titanium, zinc, silicon, boron, or combinations including at least one of the foregoing, for example, while choices for an oxidizing agent include at least one of boron oxide, silicon oxide, chromium oxide, manganese oxide, iron oxide, copper oxide, nickel oxide, silver oxide, lead oxide, polytetrafluoroethylene (PTFE), or combinations including at least one of the foregoing, for example.

The amount and the composition of the energetic material are selected such that the energetic material does not result in an explosion. Rather, the heat generated by the energetic material is used to facilitate the chemical decomposition of the polymer in the polymer matrix, not to physically destroy the matrix such as by explosion. A weight ratio of the polymer to the energetic material can be greater than about 1:99, greater than about 1:90, greater than about 1:80, greater than about 1:70, greater than about 1:60, greater than about 1:50, greater than about 1:40, greater than about 1:30, greater than about 1:20, or greater than about 1:15 up to less than about 1:1, less than about 1:2, less than about 1:3, less than about 1:4, less than about 1:5, less than about 1:6, less than 1:7, less than 1:8, less than 1:9 or less than 1:10. These weight ratios may facilitate the heat induced controlled decomposition of the polymer.

For example, the weight ratio of the polymer to the energetic material can be from 1:99 to 1:6.

Use of energetic materials disclosed herein is advantageous as these energetic materials are stable at wellbore temperatures but can undergo a self-sustained and self-propagated reaction that is not affected by downhole fluid or hydrostatic pressure. In addition, the energetic material can react without the need for environmental oxygen supply. The self-sustained and self-propagated reaction generates heat, which facilitates the chemical decomposition of the polymer in the polymer matrix.

The DoD material may optionally include a reinforcing fiber or filler.

Alternatively, the DoD material may be free or substantially free of reinforcing fiber or filler. By "substantially free" it is meant that the composition can comprise less than 0.5, less than 0.4, less than 0.3 less than 0.2, less than 0.1, or less than 0.05 weight percent of fiber and/or filler based on total weight of the material.

Each of the embodiments of trigger herein may be pressed, additively manufactured, etc. into the desired shape so that support may be given to an actuable portion of the tool in which the trigger resides.

Referring to FIG. 1, an embodiment of a trigger 10 is illustrated. The trigger 10 comprises a DoD material 12 as described above that is disposed within a shell 14 having two parts. As illustrated the parts are pieces 14*a* and 14*b* that are adhered to one another during manufacture around the DoD material 12. The shell 14 and the DoD material 12 are structural members that will withstand a load placed thereon from a source such as hydrostatic pressure or a spring, etc. The structure has sufficient integrity to prevent actuation of a tool (not shown) in which the trigger 10 is disposed by physically preventing that actuation. However, when the trigger 10 is initiated by for example an e-match (commercially available from MJG Technologies), the DoD material 12 will generate heat and decompose both the polymer matrix of the DoD and also decompose at least the adhesive holding pieces 14*a* and 14*b* together or actually thermally decompose the shell 14 as well. In either case, the end result is the trigger 10 losing structural integrity and failing to support whatever portion of the tool was being supported thereby. This change in condition results in actuation based upon the action of the load that was formerly supported by the trigger 10. This occurs within seconds of the initiation of the DoD material 12.

Figure 2:
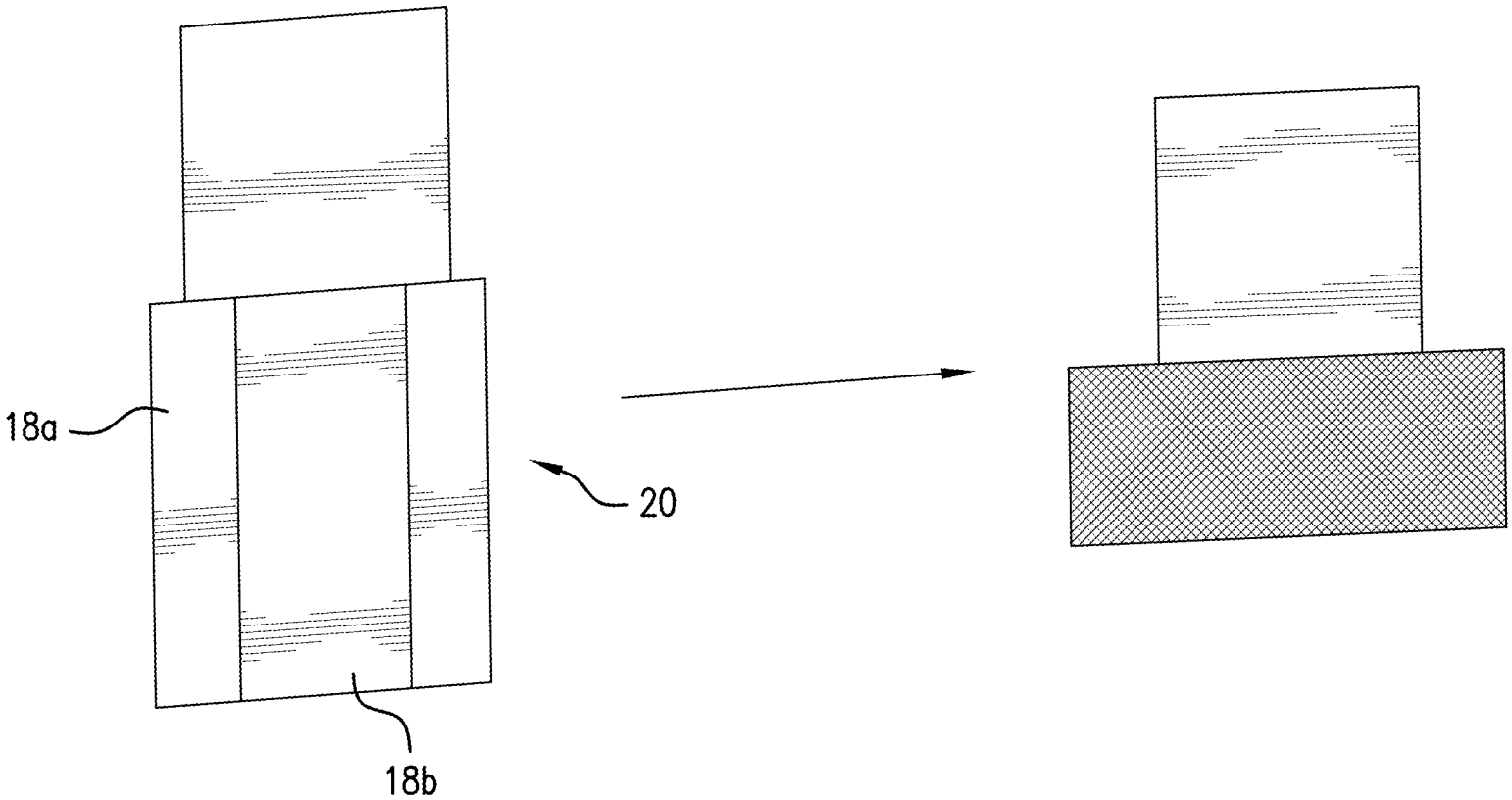
FIG. 2 illustrates a sequence of positions for a second embodiment of a trigger outside of a tool in which the trigger might be used.

In another embodiment, referring to FIG. 2, two layers 18*a* and 18*b* of DoD material are employed as a structure 20 that resists actuation. When the DoD is initiated both layers thermally degrade and the structural properties of the structure are lost. Actuation results in the ordinary course seconds after the DoD material is initiated. The two layers 18*a* and 18*b* may also have a gradient structure, for example, the layer 18*a* may have a polymer to energetic material ratio 1:99 to 1:6 to facilitate the thermally induced disintegration, the layer 18*b* may have a polymer to energetic material ratio 1:6 to 1:3 to enhance the load bearing capacity. Although both layers can thermally degrade independently, the gradient construction may be desirable in controlling the structure collapse rate or collapse direction, or counterbalance the heat loss to the environment so the structure has a more uniform temperature profile and disintegrated into finer debris.

Figure 3:
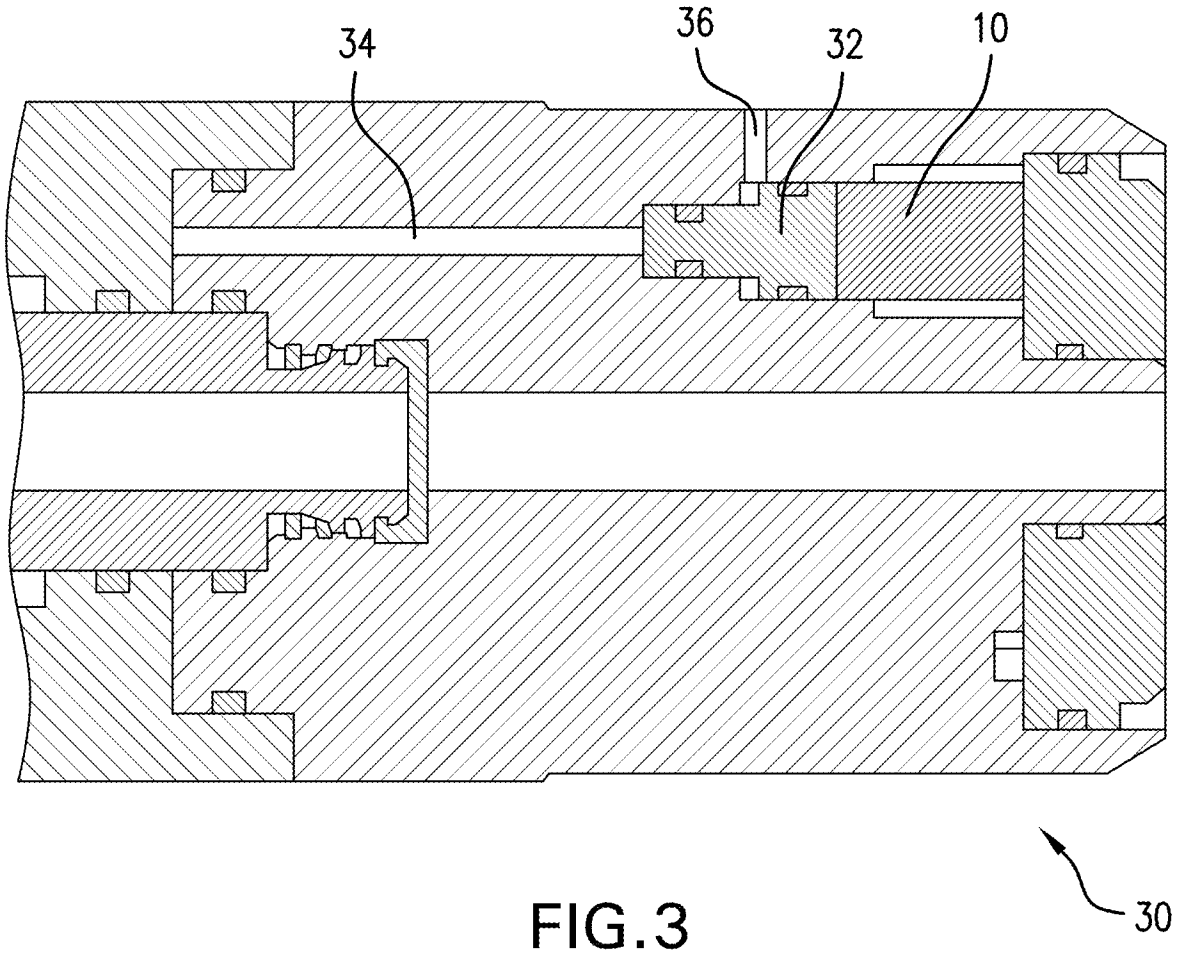
FIG. 3 is a schematic illustration of a tool employing a trigger as disclosed herein.

In an embodiment, referring to FIG. 3, the trigger 10 is disposed in a tool 30 wherein a plug member 32 is maintained between a first conduit 34 and a second conduit 36 thereby preventing flow between the conduits. The plug member 32 is biased by, for example a spring or pressure to move out of the conduits 34 and 36, but the trigger 10 prevents that movement and hence prevents actuation. When the DoD material of the trigger 10 ignites, the structural integrity of the trigger 10 degrades and the plug member 32 is pushed out of the path 35 (comprising conduits 34 and 36) by pressure or a biaser.

Figure 4:
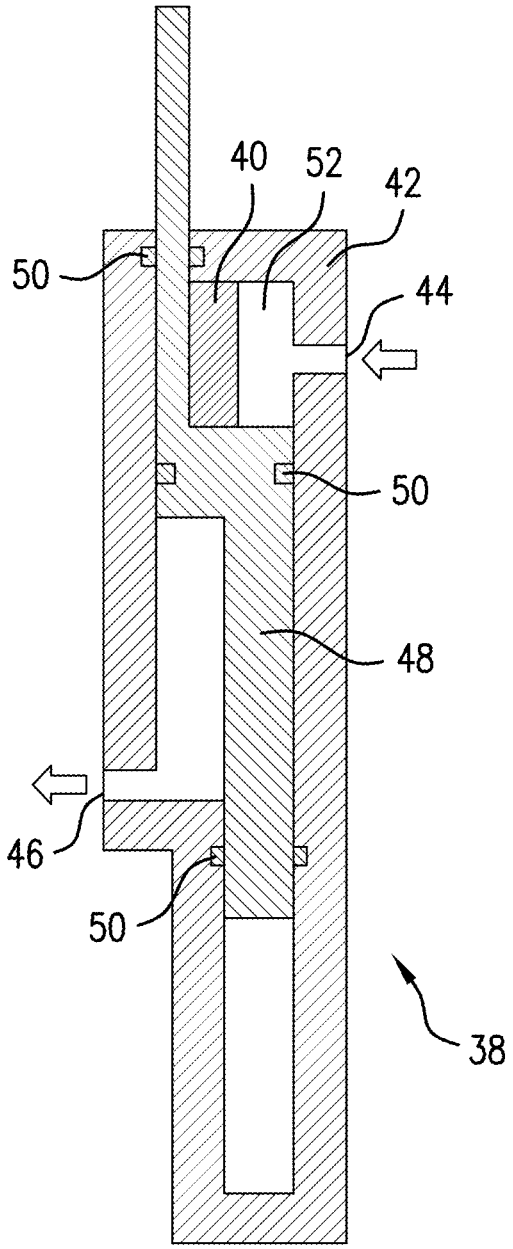
FIG. 4 is a view of a piston related embodiment in a first position prior to trigger degradation.
Figure 5:
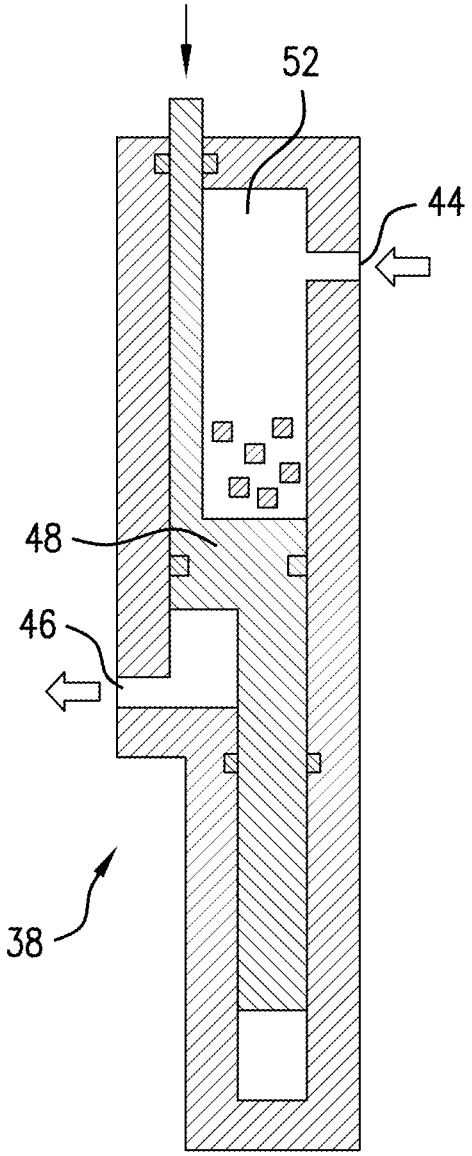
FIG. 5 is a view of a piston related embodiment in a second position after trigger degradation.

In another embodiment, referring to FIGS. 4 and 5, the DoD material is employed to prevent actuation of a tool 38 by using its volume before initiation relative to its volume after initiation. Because the DoD material degrades as noted above, the volume it displaces is significantly greater before initiation than it is after initiation. Due to this property, placing a trigger 40 in a hydraulic system allows for actuation only after initiation by initially reducing area upon which pressure can act and then increasing that area upon initiation resulting in a greater force on the piston. Specifically, referring to FIG. 4, a housing 42 includes an inlet 44 and an outlet 46. A piston 48 is movably disposed in the housing 42 and includes seals 50. Trigger 40 is disposed in an inlet chamber 52 that is fluidly connected to the inlet 44. The trigger 40 takes up space in the chamber 52 thereby reducing the force that is generated through the piston 48 by applied pressure through inlet 44. Referring to FIG. 5, upon initiation of the trigger 40, which as noted above will take only seconds to thermally degrade, an area within chamber 52 that is exposed to applied fluid pressure through inlet 44 gets larger, the larger contact area directly relates to an increase in the amount of force on the piston 48 from the applied fluid pressure through inlet 44. The tool 38 may thus be stable at relatively high inlet 44 pressures, but then when the trigger 40 is initiated, the tool 38 will be actuated since the piston 48 will, within seconds, be forced to move under the same pressure that before initiation was insufficient to acuate the tool.

Figure 6:
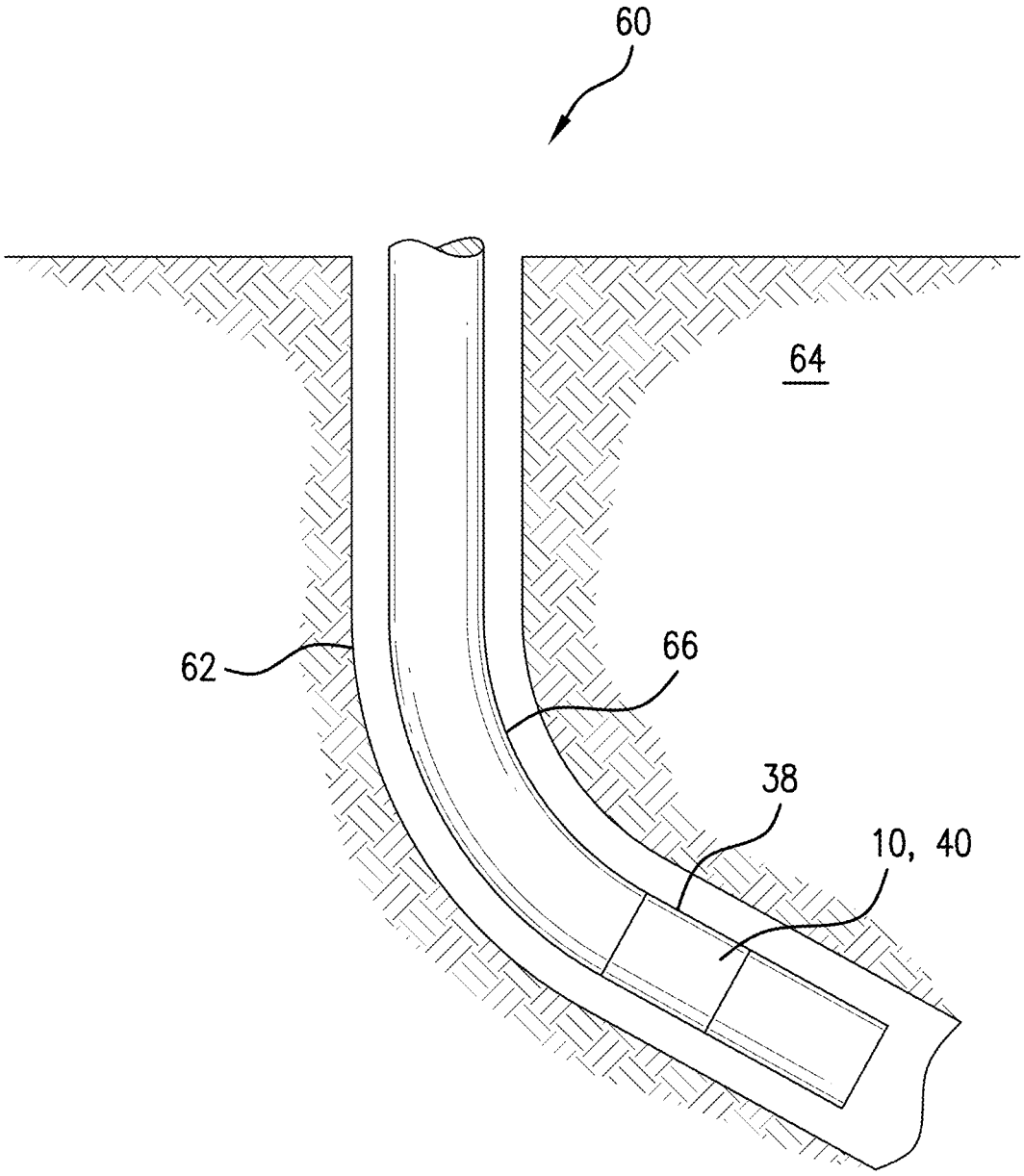
FIG. 6 is a view of a borehole system including a trigger as disclosed herein.

Referring to FIG. 6, a borehole system 60. The system 60 comprises a borehole 62 in a subsurface formation 64. A string 66 is disposed within the borehole 62. A tool such as 38, having a trigger 40, 10 as disclosed herein is disposed within or as a part of the string 66.

Set forth below are some embodiments of the foregoing disclosure:

Embodiment 1: A trigger, including a shell, and a DoD material disposed adjacent the shell piece, and an e match disposed in operable contact with the DoD material.

Embodiment 2: The trigger as in any prior embodiment, wherein the shell is a first shell piece and a second shell piece and the DoD material is disposed within an assembly of the first shell piece and the second shell piece.

Embodiment 3: The trigger as in any prior embodiment, wherein the first shell piece and the second shell piece are connected to one another with an adhesive.

Embodiment 4: A trigger including a first DoD material disposed as a load support, a second DoD material wrapped about the load support; the two materials having gradient compositions, and an e-match disposed in operable contact with the first DoD material, the second DoD material, or both.

Embodiment 5: A downhole tool, including a housing, first and second conduits defined in the housing, a plug member disposed between the first and second conduits, the plug member be biased to a position that allows flow past the plug member, and a trigger disposed to hold the plug member in a position that denies flow past the plug member, the trigger comprising a DoD material.

Embodiment 6: A downhole tool, including a housing defining an inlet and an outlet for fluid, a piston disposed in the housing, and a trigger disposed on the piston within an inlet chamber of the housing, the trigger reducing a piston area of the piston from a full piston area defined by the piston to an area smaller than the full piston area defined by the piston.

Embodiment 7: The tool as in any prior embodiment, wherein the trigger upon initiation and thermal degradation is reduced in volume thereby increasing the area of the piston exposed to fluid pressure through the inlet.

Embodiment 8: The tool as in any prior embodiment, wherein the piston moves in response to fluid pressure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A trigger, comprising:

a shell piece; and a disappear on demand (DoD) material comprising a polymeric matrix having a gradient structure disposed adjacent the shell piece to control structure collapse rate and/or collapse direction; and an e match disposed in operable contact with the DoD material.

2. The trigger as claimed in claim 1, wherein the shell piece is a first shell piece and a second shell piece and the DoD material is disposed within an assembly of the first shell piece and the second shell piece.

3. The trigger as claimed in claim 2, wherein the first shell piece and the second shell piece are connected to one another with an adhesive.

4. A trigger comprising:

a first disappear on demand (DoD) material disposed as a compressive load support;

a second DoD material wrapped about the compressive load support; the two materials having different gradient compositions, and an e-match disposed in operable contact with the first DoD material, the second DoD material, or both.

5. A downhole tool, comprising:

a housing;

first and second conduits defined in the housing;

a plug member disposed between the first and second conduits, the plug member be biased to a position that allows flow past the plug member; and a trigger as claimed in claim 4, disposed to hold the plug member in a position that denies flow past the plug member, the trigger comprising a DoD material.

6. A downhole tool, comprising:

a housing defining an inlet and an outlet for fluid;

a piston disposed in the housing; and a trigger disposed on the piston within an inlet chamber of the housing, the trigger reducing a piston area of the piston from a full piston area defined by the piston to an area smaller than the full piston area defined by the piston.

7. The tool as claimed in claim 6, wherein the trigger upon initiation and thermal degradation exposes additional area of the piston to fluid pressure through the inlet.

8. The tool as claimed in claim 6, wherein the piston moves in response to fluid pressure.

* * * * *